US012000670B2

(12) United States Patent
Anselmo et al.

(10) Patent No.: US 12,000,670 B2
(45) Date of Patent: Jun. 4, 2024

(54) ARCHERY BOW SUPPORT AND RELATED APPARATUSES

(71) Applicant: Hoyt Archery, Inc., Salt Lake City, UT (US)

(72) Inventors: Dan'l J. Anselmo, South Jordan, UT (US); Kevin T. Shamblen, West Jordan, UT (US)

(73) Assignee: Hoyt Archery, Inc., Salt Lake City, UT (US)

( * ) Notice: Subject to any disclaimer, the term of this patent is extended or adjusted under 35 U.S.C. 154(b) by 0 days.

(21) Appl. No.: 17/903,244

(22) Filed: Sep. 6, 2022

(65) Prior Publication Data

US 2024/0077274 A1 Mar. 7, 2024

(51) Int. Cl.
*F41B 5/14* (2006.01)
*F41B 5/10* (2006.01)

(52) U.S. Cl.
CPC ..... *F41B 5/1453* (2013.01); *F41B 5/105* (2013.01)

(58) Field of Classification Search
CPC ..... F41B 5/1426; F41B 5/1453; F41B 5/105; F41A 23/08; F41A 23/12
USPC ..... 124/86, 1, 23.1, 25, 25.6
See application file for complete search history.

(56) References Cited

U.S. PATENT DOCUMENTS 3,741,355 A * 6/1973 Slan ..... A45C 3/001 190/126
6,957,648 B1 * 10/2005 Adcock ..... F41B 5/1426 124/89
8,844,509 B2 9/2014 Howard
2004/0074485 A1 * 4/2004 Cooper ..... F41B 5/105 124/25.6
2005/0150484 A1 * 7/2005 Horn ..... F41B 5/14 248/176.1
2009/0272369 A1 * 11/2009 Konczal ..... F41B 5/105 29/428
2013/0291846 A1 * 11/2013 Arndt ..... F41B 5/1453 124/23.1
2013/0291850 A1 * 11/2013 Howard ..... F41B 5/105 124/86
2014/0026875 A1 * 1/2014 Howard ..... F41B 5/105 124/900
2015/0040882 A1 * 2/2015 Howard ..... F41B 5/105 124/86
2019/0025009 A1 * 1/2019 Carpenter ..... F41B 5/1453
2022/0018628 A1 * 1/2022 Coalson ..... F41B 5/1453
2022/0049923 A1 * 2/2022 Popa ..... F41B 5/1453
2022/0155038 A1 * 5/2022 Leis ..... F41B 5/1453

* cited by examiner

*Primary Examiner* — John E Simms, Jr.

(57) ABSTRACT

An archery bow includes a cam assembly having a component projecting or extending beyond a periphery of the cam assembly of the archery bow to enable an archer to set the archery bow upright on a support surface. For example, the component can be affixed to one or more elements of the cam assembly (e.g., a cam, a module, etc.) and can displace the cam assembly a distance from the support surface when the archery bow is disposed upright on the support surface.

18 Claims, 17 Drawing Sheets

ARCHERY BOW SUPPORT AND RELATED APPARATUSES

TECHNICAL FIELD

The present disclosure generally relates to archery equipment and specifically relates to incorporating a support onto an archery bow.

BACKGROUND

Bowhunters and other archers use finely tuned archery equipment to launch arrows and other projectiles down range at one or more targets. While waiting to launch arrows, taking a break, or awaiting wild game to walk across the archers' path, the archer may set their archery bow down on the ground or another surface. Additionally, the archer may rest the bow on the ground or another surface while retrieving arrows previously launched at respective targets. The design and features of the archery bow can affect the archer's ability to set the bow down on a surface while the archery bow is not being operated by the archer.

SUMMARY

One aspect of the present disclosure relates to an archery bow including a riser, an upper limb, a lower limb, a bowstring, a cable, an upper cam assembly, and a lower cam assembly. The riser has an upper portion and a lower portion. The upper limb is coupled to the upper portion of the riser. The lower limb is coupled to the lower portion of the riser. The bowstring extends between the upper limb and the lower limb. The lower cam assembly includes a rotatable member and a component affixed to the rotatable member. The rotatable member is rotatably coupled to the lower limb. The component includes a body portion and elastomeric material. The body portion protrudes beyond a periphery defined by the rotatable member. The elastomeric material is coupled to the body portion. The elastomeric material forms a surface configured to contact a support surface when the archery bow is placed upright on the support surface.

In some examples, the component can be a first component and the lower cam assembly further comprises a second component configured to engage the cable when the bowstring is drawn by an archer. In some examples, the component can be affixed to the rotatable member by a fastener. In some examples, the component protrudes a distance beyond the periphery and the component has a width equal to or greater than the distance. In some examples, the component can be integrally formed with the rotatable member. In some examples, the body can define a feature configured to at least partially receive the elastomeric material. The feature can be a groove and the elastomeric material can be an O-ring disposed within the groove. In some examples, a surface of the lower limb can define a plane. The component can be disposed on a first side of the plane and a handle portion of the riser can be disposed on a second side of the plane. In some examples, the component can include a plurality of discrete protrusions.

Another aspect of the disclosure relates to an archery bow including a riser, a limb, a bowstring, and a cam assembly. The limb is coupled to the riser. The cam assembly includes a rotatable member, a first component, and a second component. The rotatable member is rotatably coupled to the limb. The first component is configured to engage a cable when the bowstring is drawn by an archer. The second component is affixed to the rotatable member and wholly disposed on a first side of a plane formed within the bowstring groove. The second component forms an engagement surface configured to contact a support surface while the archery bow is disposed upright on the support surface.

In some examples, the cam assembly can be a first cam assembly and the archery bow further comprises a second cam assembly. The second cam assembly is configured to be displaced further from the support surface than the first cam assembly while the archery bow is disposed upright on the support surface. In some examples, the engagement surface can be a first engagement surface of at least two distinct engagement surfaces that retain the archery bow upright on the support surface. The at least two distinct engagement surfaces can include the first engagement surface, a second engagement surface, and a third engagement surface. The second engagement surface and the third engagement surface can be disposed on opposing sides of a center plane defined by the riser.

In some examples, only a portion of the engagement surface may contact the support surface while the archery bow is disposed upright on the support surface. In some examples, the first component can be repositionable on the rotatable member about an axis of rotation of the rotatable member and the second component can be integrally formed with the rotatable member In some examples, the second component can include an elastomeric material and the engagement surface can be at least partially formed by the elastomeric material.

Yet another aspect of the present disclosure relates to a component for an archery bow. The component includes a body configured to be affixed to a rotatable member of an archery bow. The body defines a portion protruding beyond a periphery defined by the rotatable member. The portion forms an engagement surface configured to contact a support surface while the archery bow is disposed upright on the support surface. The body has a thickness that is equal to or greater than a distance the portion protrudes beyond the periphery.

In some examples, the body can include an elastomeric material. The elastomeric material can the portion configured to contact the support surface while the archery bow is disposed upright on the support surface. The body can define a feature configured to couple the elastomer material to the body.

The above summary of the present invention is not intended to describe each embodiment or every implementation of the present invention. The Figures and the detailed description that follow more particularly exemplify one or more preferred embodiments.

BRIEF DESCRIPTION OF THE DRAWINGS

The accompanying drawings and figures illustrate a number of exemplary embodiments and are part of the specification. Together with the present description, these drawings demonstrate and explain various principles of this disclosure. A further understanding of the nature and advantages of the present invention may be realized by reference to the following drawings. In the appended figures, similar components or features may have the same reference label.

Figure 1A:
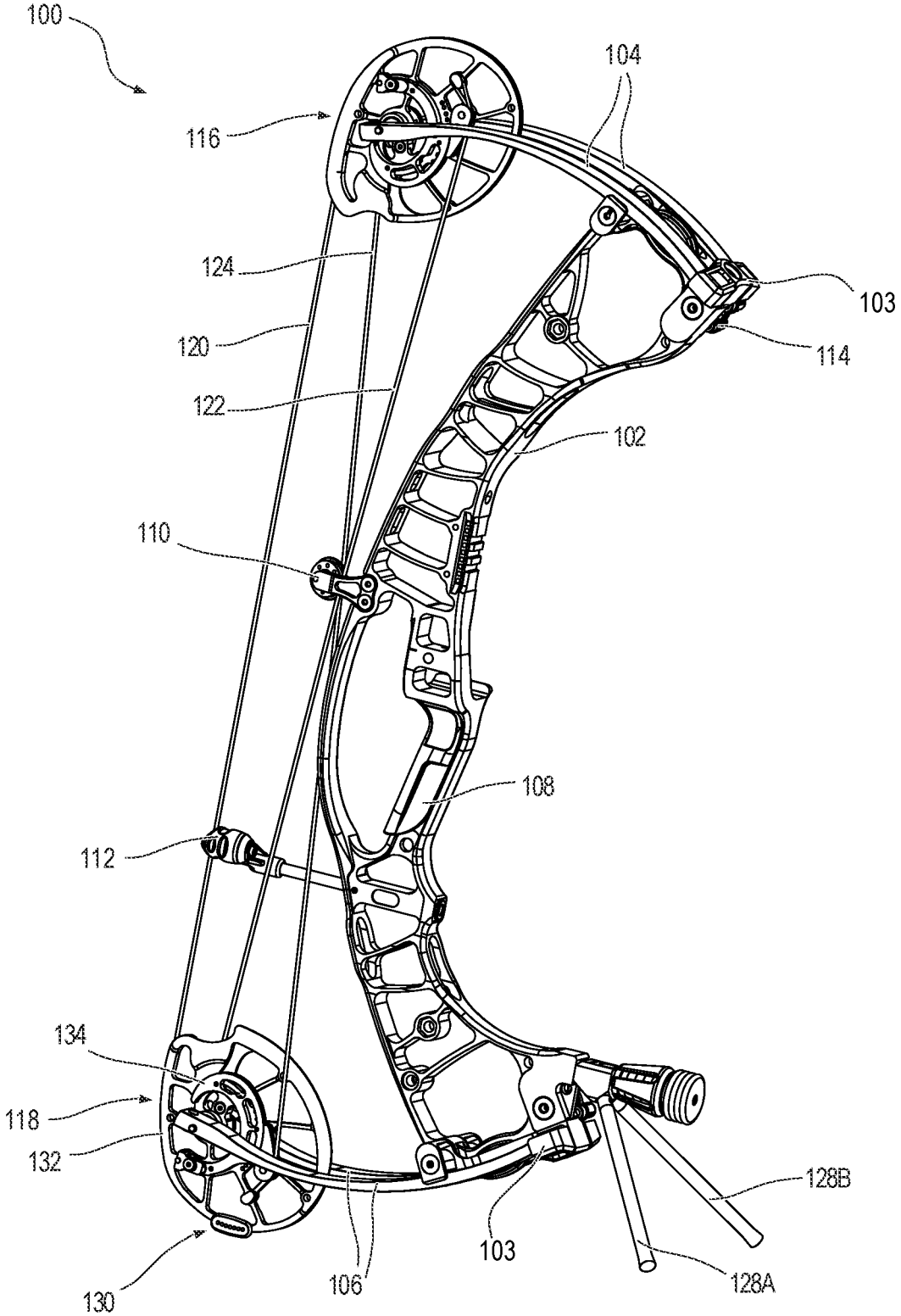
FIG. 1A is a perspective side view of an archery bow.
Figure 1B:
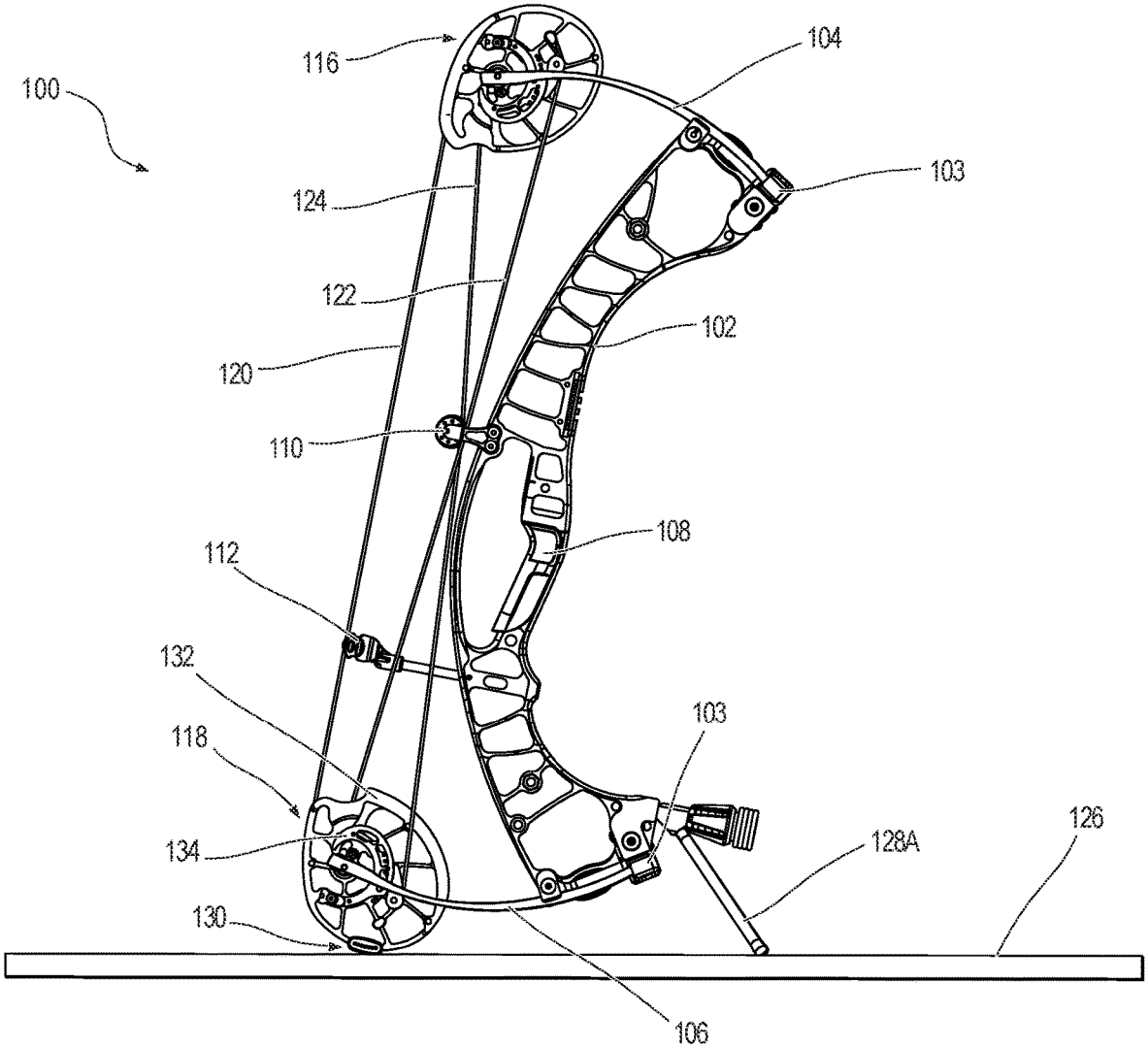
FIG. 1B is a side view of the archery bow on a support surface, according to some embodiments.
Figure 1C:
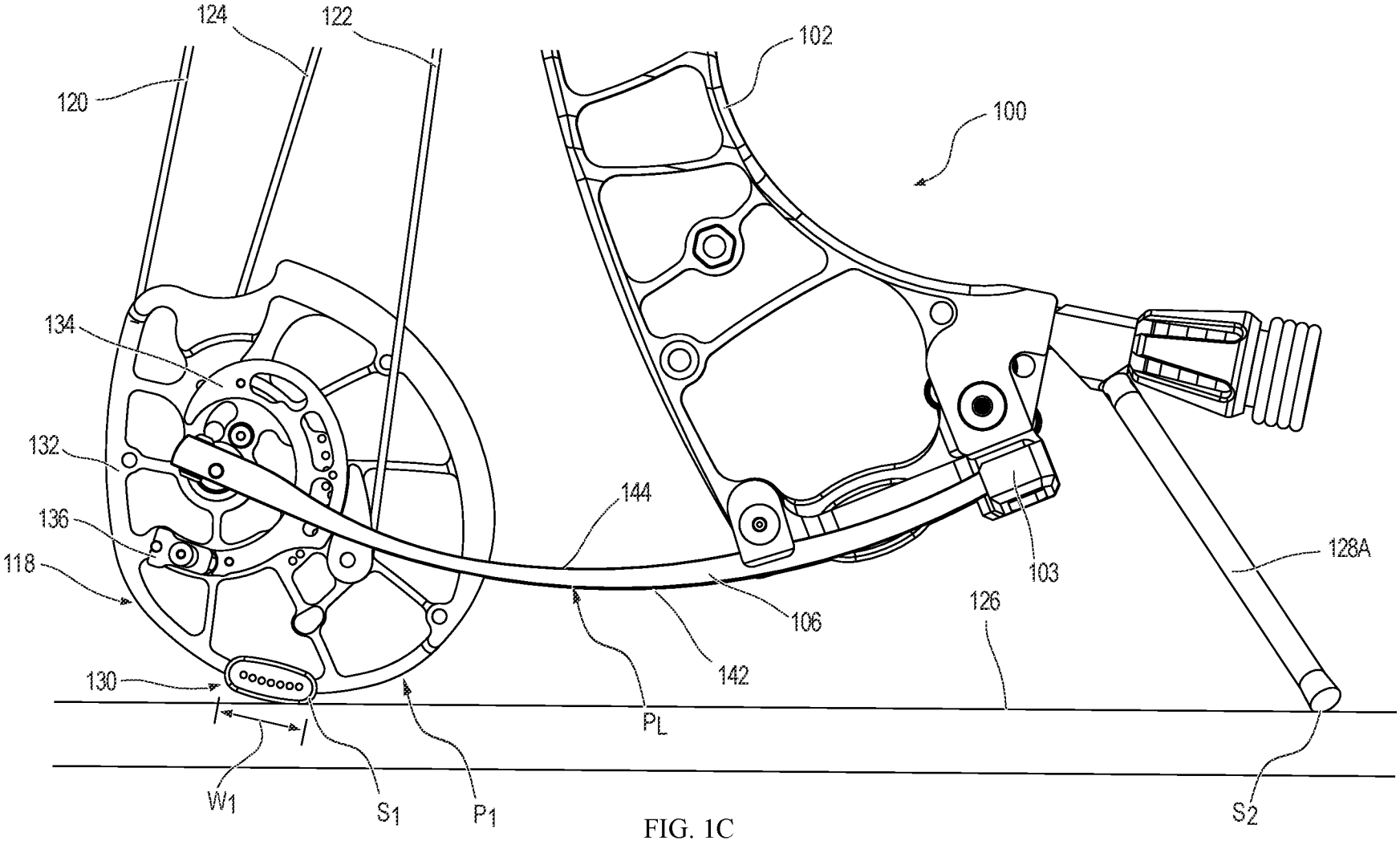
FIG. 1C is a detail side view of the archery bow on the support surface, according to some embodiments.
Figure 1D:
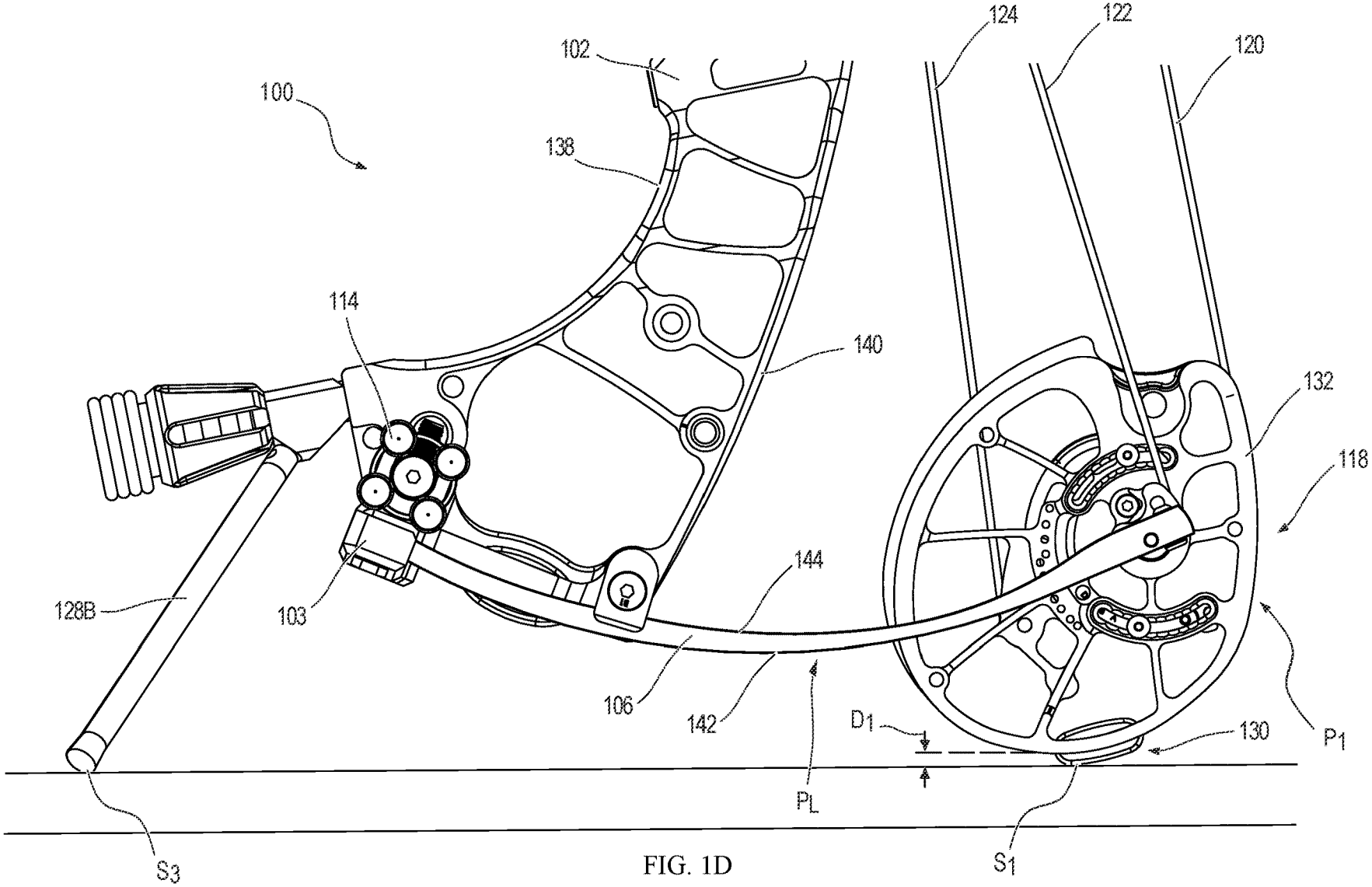
FIG. 1D is a detail side view of the archery bow on the support surface, according to some embodiments.

While the embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the instant disclosure covers all modifications, equivalents, and alternatives falling within the scope of the appended claims.

DETAILED DESCRIPTION

One aspect of the present disclosure generally relates to incorporating a component projecting or extending beyond a periphery of a cam assembly of a compound archery bow to enable an archer to set the archery bow upright on a support surface. In some examples, the component can be affixed to one or more elements of the cam assembly (e.g., a cam, a module, etc.) and can displace the cam assembly a distance from the support surface when the archery bow is disposed upright on the support surface. For example, the component can form or define a surface that engages or contacts the support surface while the archery bow is placed upright on the support surface. While placed upright on the support surface, an upper cam assembly can be displaced further from the support surface than the lower cam assembly. In other words, the upper cam assembly can be disposed at a higher elevation relative to the support surface than the lower cam assembly.

In some examples, the component can include a body and an elastomeric material affixed to the body. The body and/or elastomeric material can define or form a surface that contacts or engages the support surface while the archery bow is placed upright on the support surface. For example, the elastomeric material can be at least partially disposed within a groove, channel, or other feature formed by the body such that the elastomeric material is disposed between the body and the support surface while the archery bow is disposed upright on the support surface. The component can extend or protrude a distance beyond the periphery of the cam assembly. For example, the component can extend beyond a periphery defined or formed by a cam and/or module of the cam assembly. In some examples, the component can be disposed laterally adjacent to a bowstring groove defined by the cam. In some examples, the component can be integrally formed with one or more elements of the cam assembly (e.g., the cam, the module, etc.). Additionally, or alternatively, the component can be releasably clipped, coupled, or fastened to one or more elements of the cam assembly (e.g., the cam, the module, etc.).

The present description provides examples, and is not limiting of the scope, applicability, or configuration set forth in the claims. Thus, it will be understood that changes may be made in the function and arrangement of the cover members, protrusions, and/or other elements of the archery bow discussed without departing from the spirit and scope of the disclosure, and various embodiments may omit, substitute, or add other procedures or components as appropriate. For instance, features described with respect to certain embodiments may be combined in other embodiments.

Referring now to the figures in detail, FIG. 1A shows a compound archery bow 100. The bow 100 is at a rest position (e.g., a brace state or brace position). The bow 100 can comprise a riser 102 from which one or more upper limbs 104 and one or more lower limbs 106 extend. For example, the upper limbs 104 can be affixed to the riser 102 by one or more limb pockets 103. The bow 100 can include a handle portion or grip 108, a roller guard or cable guard 110, a string-stop damper 112, dampers 114, and other components.

The upper limbs 104 may be connected to an upper cam assembly 116, and the lower limbs 106 may be connected to a lower cam assembly 118. A bowstring 120 (i.e., draw string) may extend across the length of the bow 100 between the upper cam assembly 116 and the lower cam assembly 118. The terminal ends of the bowstring 120 may be attached to and held entrained to the cam assemblies 116, 118, at least in the brace position, and the limbs 104, 106 may be flexed to store energy and retain tension in the bowstring 120. A first cable 122 and a second cable 124 may also be attached to and extend between the upper cam assembly 116 and the lower cam assembly 118. Collectively, the first cable 122 and the second cable 124 may be referred to herein as the cables of the bow 100. The first and second cables 122, 124 may retain tension in the limbs 104, 106 and cam assemblies 116, 118 and may be controlled to adjust tension in the bowstring 120.

The figures illustrate example archery apparatuses that may be used in conjunction with the principles and teachings of the present disclosure. Thus, while the archery bows described herein are compound bows, it will be understood by those having ordinary skill in the art that the components of the archery bow, accessories, and related methods and apparatuses included in embodiments of the present disclosure may be applied to components and apparatuses in compound bows, recurve bows, crossbows, their accessories, and other equipment related to archery. Similarly, archery equipment applying the teachings of the present disclosure does not need to implement all of the features of the present disclosure. For example, in some embodiments, the bow may not comprise a cable guard 110 or a string-stop damper 112, so features associated with those accessories may be omitted from the bow 100.

When shooting an arrow, the tail end of the arrow may be nocked with the bowstring 120 at a nocking point (not shown) while the bow 100 is in the brace position shown in FIG. 1A. The bowstring 120 may be drawn rearward to a full draw position, thereby partially unraveling the bowstring 120 from the outer grooves of the cam assemblies 116, 118. The archer may grasp the grip 108 of the riser 102 and draw back the bowstring 120 (e.g., by using a D-loop, not shown). As the limbs 104, 106 flex inward and the cables 122, 124 wind around the cam assemblies 116, 118, the cables 122, 124 may slide along or may be in rolling contact with portions of the cable guard 110, which may comprise at least one roller or other smooth support in contact with the cables 122, 124 where they contact the cable guard 110.

When the bowstring 120 is released, the potential/stored energy in the limbs 104, 106 is released, and the bowstring 120 quickly accelerates back toward the brace position (shown in FIG. 1A) as it applies a shooting force to an end of the projectile (e.g., an arrow). As the limbs 104, 106 release their energy, the cam assemblies 116, 118 are spread apart, and the terminal ends of the bowstring 120 wrap around the cam assemblies 116, 118, and the cables 122, 124 unwind from the cam assemblies 116, 118. A portion of the bowstring 120 may contact the string-stop damper 112, which can help dampen vibrations in the bowstring 120, and the cables 122, 124 may roll or slide against the cable guard 110 as the cam assemblies 116, 118 move.

In some examples, the bow 100 can include one or more components that form engagement surfaces with a support surface 126 when the archery bow 100 is placed upright on the support surface 126, such that the archery bow 100 remains in a static or standing position on the support surface 126 without requiring a user (e.g., an archer) to maintain physical contact with the archery bow 100 for the archery bow 100 to remain upright/standing. In some examples, the archery bow 100 can be considered upright on the support surface 126 when the upper cam assembly 116 is displaced further from the support surface 126 than the lower cam assembly 118. For example, the archery bow 100 can include one or more support members 128A, 128B affixed to the riser 102, the pocket 103, the lower limbs 106, or a combination thereof. The support members 128A, 128B can remain affixed to the archery bow 100 while the archer is operating the archery bow (e.g., launching projectiles) or can otherwise be coupled to the archery bow 100 before the archer sets the archery bow 100 down on the support surface 126, for example, to leave the archery bow 100 in an upright or standing position on the support surface 126 while the archer fetches or retrieves previously launched arrows.

As shown in FIGS. 1B-1F, one or more components 130 of the lower cam assembly 118 can form or define another engagement surface on the support surface 126 when the archery bow 100 is placed upright on the support surface 126. As such, a combination of the support members 128A, 128B and the one or more components 130 can form displaced engagement surfaces engaging the support surface 126 sufficient to retain the archery bow 100 in a static and upright position on the support surface 126. The component 130 can prevent or limit a rotatable member or cam 132 and a portion of the bowstring 120 wrapped around the cam 132 from contacting the support surface 126 while the archery bow 100 is positioned on the support surface 126 (see FIG. 1D). At least a portion of the component 130 protrudes or extends a distance $D_1$ beyond an outside edge or periphery $P_1$ defined by the cam 132. The periphery $P_1$ can be defined as a line or surface extending along the outermost edge of the cam 132.

Figure 1E:
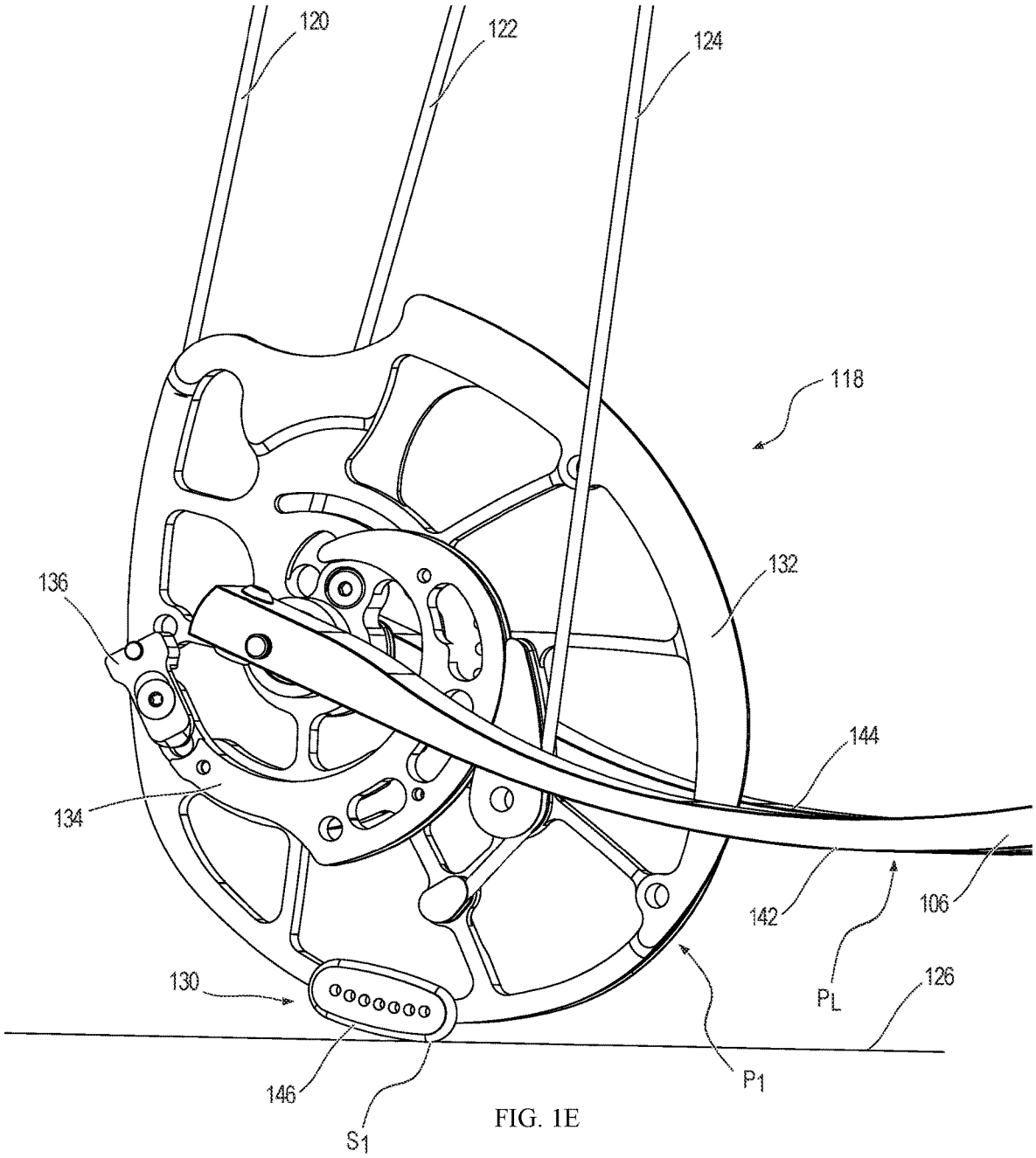
FIG. 1E is a perspective side view of the archery bow on the support surface, according to some embodiments.
Figure 1F:
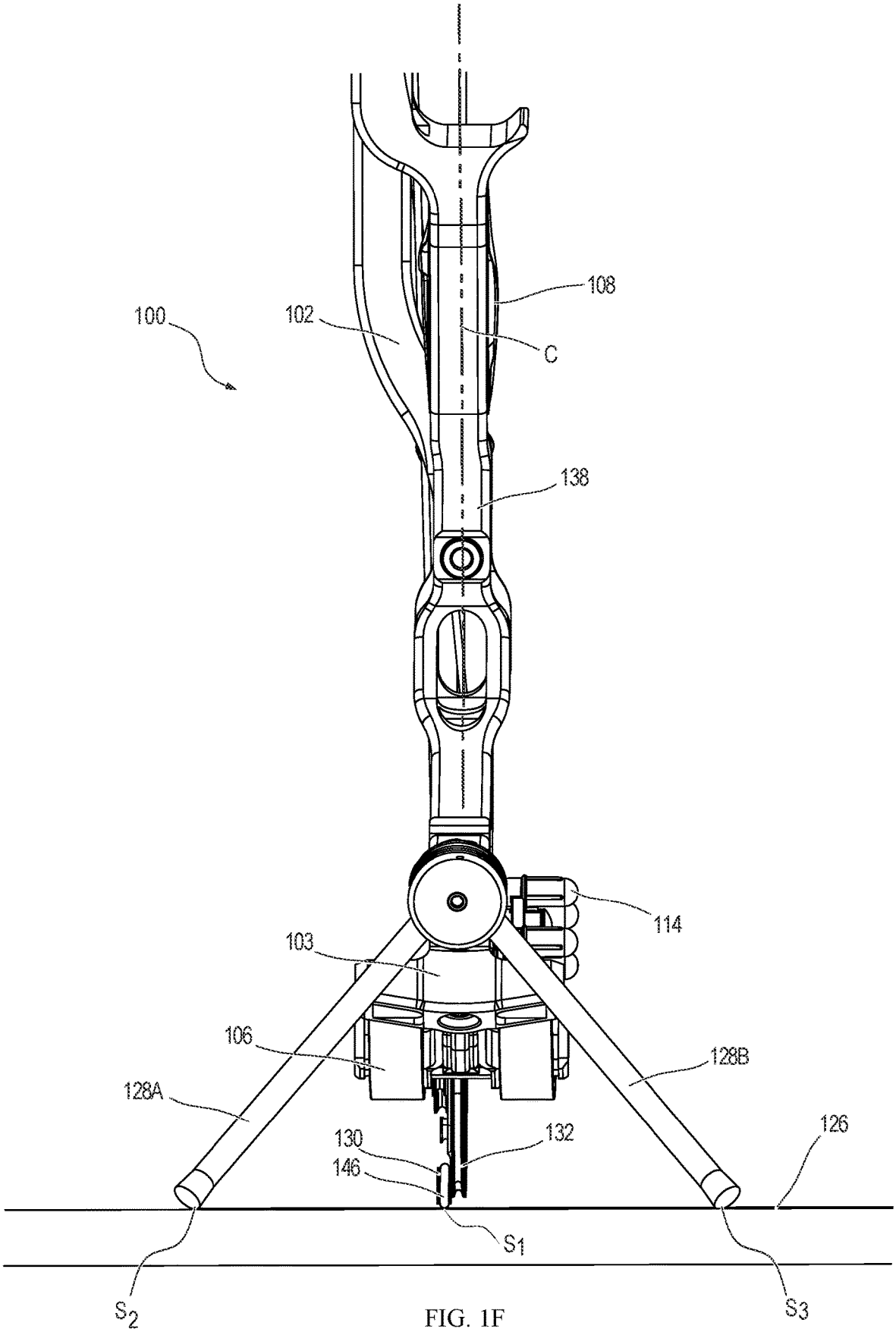
FIG. 1F is a front detail view of the archery bow on the support surface, according to some embodiments.

In some examples, the lower cam assembly 118 can include a module 134 and a portion of the module 134 can extend beyond the periphery $P_1$ of the cam 132. For example, as shown in FIG. 1E, the module 134 can be rotated relative to the cam 132 to vary a characteristic of the archery bow 100 (e.g., draw weight, draw length, etc.). In the rotated position, the module 134 can have a foot 136 at least partially extending beyond the periphery of the cam 132. However, as shown in FIG. 1E, the foot 136 of the module 134 does not contact the support surface 126 when the archery bow 100 is placed upright on the support surface 126 to prevent or limit the cam 132 and/or bowstring 120 from contacting the support surface 126.

In some examples, the component 130 can extend a width $W_1$ along the periphery $P_1$ of the cam 132 such that the component 130 can contact the support surface 126 despite the cam 132 be repositionable among multiple orientations. For example, the cam 132 can have a particular orientation for a corresponding draw length yet have a different orientation for a different draw length. The width $W_1$ of the component 130 can ensure the component 130 can contact the support surface 126 in each respective orientation associated with each respective draw length. In some examples, the width $W_1$ can be equal to or greater than the distance $D_1$ the component 130 protrudes or extends from the periphery $P_1$ of the cam 132. While the component 130 is depicted in FIGS. 1A-1F having particular characteristics (e.g., size, shape, position, etc.), in other examples, the component 130 can have one or more dissimilar characteristics. For example, the component 130 can be formed from a plurality of discrete protrusions extending or protruding beyond the periphery $P_1$ of the cam 132.

In some examples, the width $W_1$ can be at least 0.5 centimeters (cm), between about 0.5 cm and about 1 cm, between about 1 cm and about 1.5 cm, between about 1.5 cm and about 2 cm, between about 2 cm and about 2.5 cm, between about 2.5 cm and about 3 cm, or greater than 3 cm. In some examples, the distance $D_1$ can be at least 2 millimeters (mm), between about 2 mm and about 4 mm, between about 4 mm and about 6 mm, between about 6 mm and about 8 mm, between about 8 mm and about 10 mm, between about 10 mm and about 15 mm, or greater than 15 mm.

The component 130 can form one of a plurality of engagement surfaces between the archery bow 100 and the support surface 126 that enable the archery bow 100 to by placed upright on the support surface 126 and remain static or stationary without additional support from the archer. For example, the component 130 can define a first engagement surface $S_1$ and the support members 128A, 128B can define second and third engagement surfaces $S_2$, $S_3$. The second and third engagement surfaces $S_2$, $S_3$ can be disposed on opposing lateral sides of a center plane C of the riser 102. The first engagement surface $S_1$ can be disposed adjacent a bowstring groove of the cam 132. The engagement surface $S_1$ is laterally offset from a plane (see FIG. 2C) defined within the bowstring groove. For example, the component 130 can be wholly disposed on one side of the plane, such that, the component 130 cannot interfere with the bowstring 120 as the archery bow 100 is operated. The second and third engagement surfaces $S_2$, $S_3$ can be disposed forward of the riser 102 (i.e., inline or forward of a forward-facing surface 138 of the riser 102) while the first engagement surface $S_1$ can be disposed on rearward of the riser 102 (i.e., inline or reward of a rearward-facing surface 140 of the riser 102). The lower limbs 106 can include a respective tensile surface 142 and a respective compression surface 144 on opposing sides of each limb. In some examples, the tensile surface 142 can form or define a plane $P_L$ extending parallel to the tensile surface 142. The component 130 and the grip 108 can be disposed on opposing sides of the plane $P_L$.

In some examples, the component 130 can include an elastomeric element 146 at least partially forming the engagement surface $S_1$. The elastomeric element 146 can be molded, machined, stamped, or otherwise formed of any polymer, such as, a synthetic polymer or a natural polymer. The elastomeric element 146 can be coupled to the component 130. For example, the elastomeric element 146 can be at least partially disposed within a groove, channel, or other feature formed by the component 130 such that the elastomeric element 146 is disposed between the component 130 and the support surface 126 while the archery bow 100 is disposed upright on the support surface 126.

In some examples, the component 130 can be integrally formed with the cam 132, such as, machined from a singular piece of aluminum or other suitable material. In some examples, the component 130 can be fastened, adhered, or otherwise affixed to the cam 132. For example, the component 130 can define a feature (e.g., an aperture, channel, slot, etc.) enabling the component 130 to at least partially receive a fastener to affix the component 130 to the cam 132. In some examples, the lower cam assembly 118 can include the module 134 configured to engage a portion of a cable (e.g., first or second cable 122, 124). In some examples, the component 130 can be formed as part of, or otherwise coupled to, the module 134 (see FIGS. 3A-3B). In some examples, the component 130 can be removably affixed to the lower cam assembly 118, such as, clipping or engaging to one or more structural elements of the cam 132 or the module 134 (see FIGS. 4A-4D).

Some archery bows include cams having extended fins or flared sidewalls next to the string groove to assist in retaining the bow string within the string groove after the archery bow launches an arrow. However, these fins or extended sidewalls would not provide a suitable surface for resting the archery bow on a support surface in an upright position because a fin or flared sidewall is susceptible to bending or deforming when contacting the support surface.

Figure 2A:
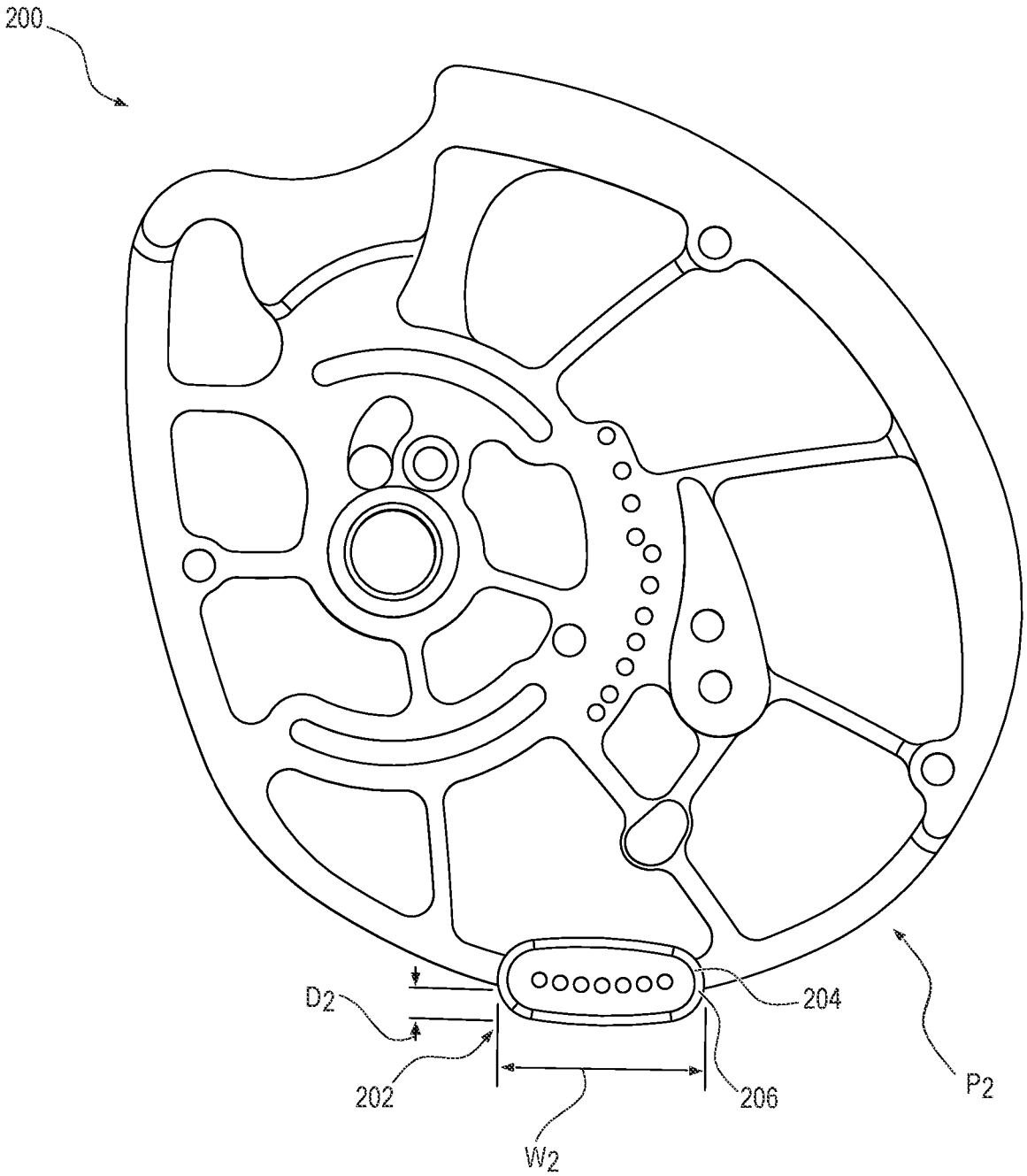
FIG. 2A is a side view of a cam for an archery bow, according to some embodiments.
Figure 2B:
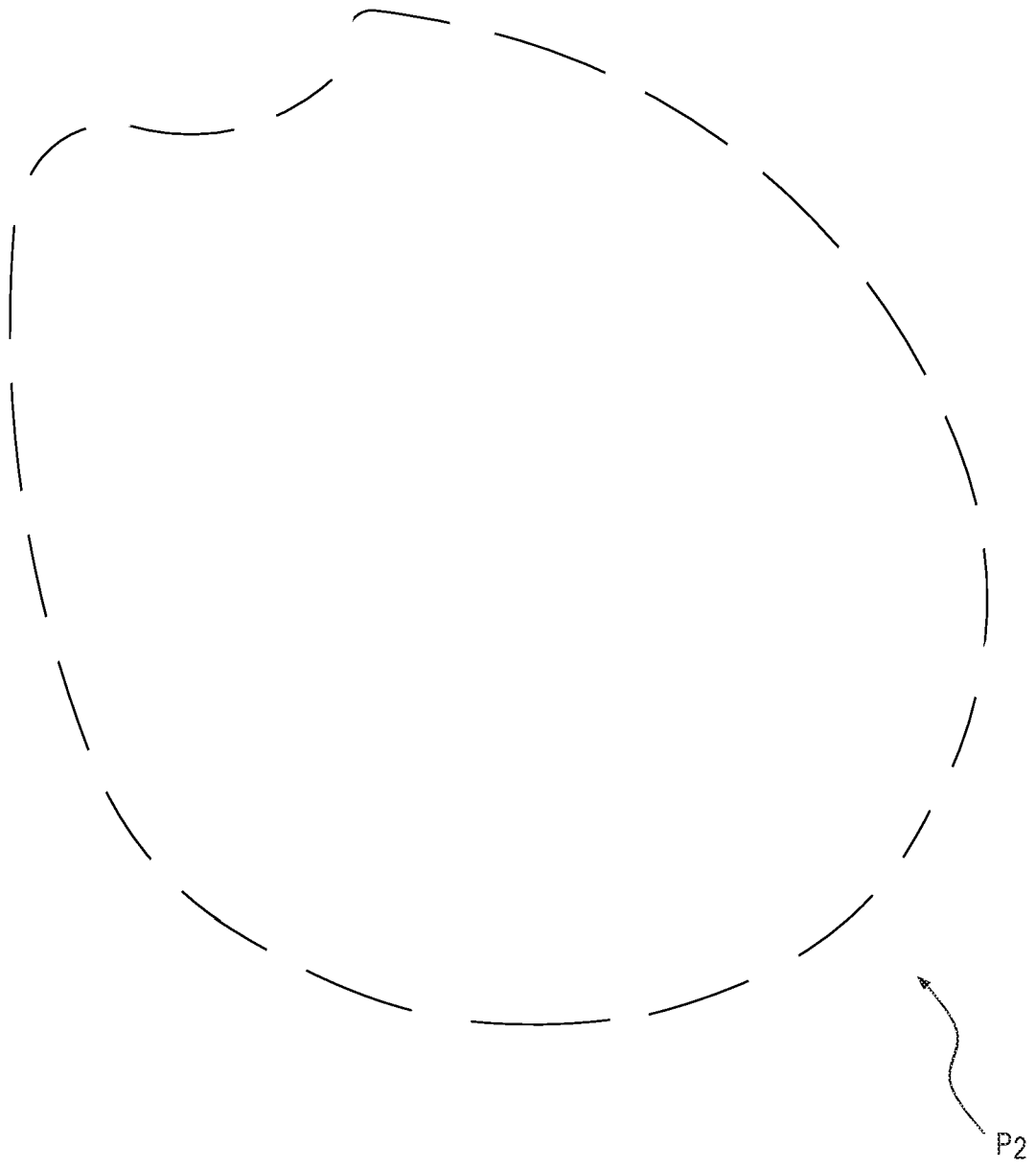
FIG. 2B is a side view of a periphery of the cam, according to some embodiments.
Figure 2C:
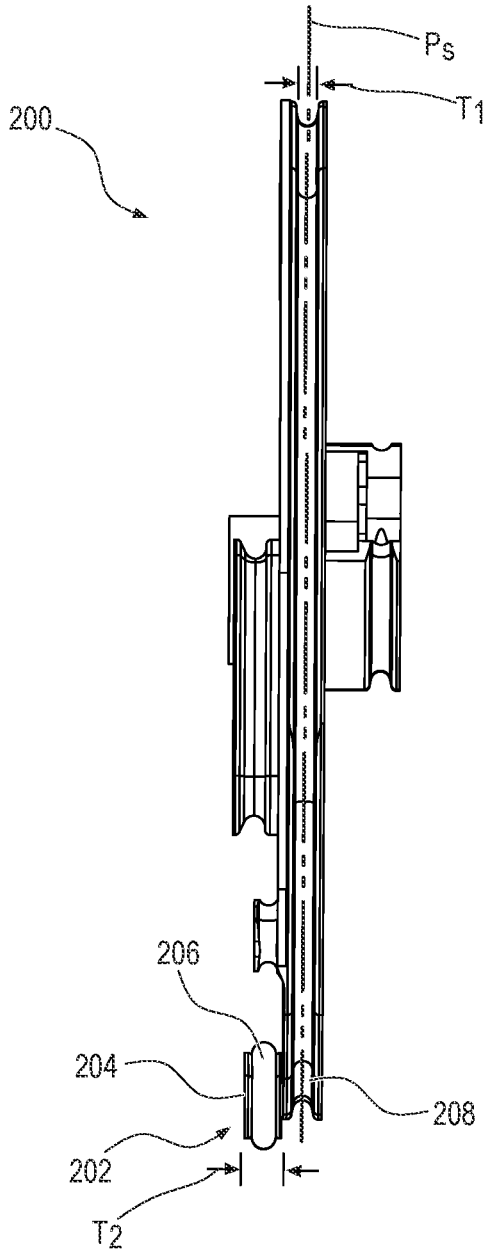
FIG. 2C is a front view of the cam, according to some embodiments.

FIG. 2A shows a rotatable member or cam 200 for an archery bow including a component 202 protruding or extending beyond a periphery $P_2$ of the cam 200. The component 202 can be substantially similar to, and can include some or all of, the features of the component 130. For example, the component 202 can include a body 204 and an elastomeric element 206. The periphery $P_2$ can be defined by an outside edge or an outer boundary of the cam 200. In some examples, a module (e.g., module 134) can extend beyond an outside edge or outer boundary of the cam 200 (see foot 136 in FIG. 1E). In these examples, the module can contribute to or otherwise form at least a portion of the periphery $P_2$ and the component 202 can extend beyond the periphery $P_2$ to form an engagement surface for contacting a support surface (not shown) while the archery bow is placed in an upright position on the support surface.

In some examples, the cam 200 can define a bowstring groove 208 extending along at least a portion of the periphery $P_2$ of the cam 202. As shown in FIGS. 2A-2D, the body 204 of the component 202 can be integrally formed or otherwise affixed to the cam 200 such that at least a portion of the body 204 is disposed adjacent or lateral to the bowstring groove 208. In some examples, the body 204 can have a width $W_2$. In some examples, the width $W_2$ can extend parallel or substantially parallel to the bowstring groove 208. The component 202 can extend beyond the periphery $P_2$ a distance $D_2$. In some examples, the width $W_2$ can be equal to or greater than the distance $D_2$. In some examples, the width $W_2$ and the distance $D_2$ can form a ratio (i.e., width to distance). The ratio can be about 1:1, between about 1:1 and about 1.5:1, between about 1.5:1 and about 2:1, between about 2:1 and about 2.5:1, between about 2.5:1 and about 3:1, or greater than 3:1.

The bowstring groove 208 of the cam 200 can define a plane $P_S$ formed, defined, or otherwise disposed within the bowstring groove 208. For example, the plane $P_S$ can be defined or formed within the bowstring groove 208 at a center of the bowstring groove 208, such that, the plane $P_S$ bisects the cam 200 (i.e., approximately half the cam 200 is disposed on a first side of the plane $P_S$ and approximately half the cam 200 is disposed on a second side of the plane $P_S$). The component 202 can be wholly disposed on one side of the plane $P_S$. For example, the body 204 and the elastomeric element 206 can be wholly disposed on one side of the plane $P_S$.

In some examples, the width $W_2$ can be at least 0.5 centimeters (cm), between about 0.5 cm and about 1 cm, between about 1 cm and about 1.5 cm, between about 1.5 cm and about 2 cm, between about 2 cm and about 2.5 cm, between about 2.5 cm and about 3 cm, or greater than 3 cm. In some examples, the distance $D_2$ can be at least 2 millimeters (mm), between about 2 mm and about 4 mm, between about 4 mm and about 6 mm, between about 6 mm and about 8 mm, between about 8 mm and about 10 mm, between about 10 mm and about 15 mm, or greater than 15 mm.

In some examples, the bowstring groove 208 have a first thickness $T_1$ and the component 202 can have a second thickness $T_2$. In some examples, the first thickness $T_1$ and the second thickness $T_2$ can form a ratio. For example, the ratio of the first thickness $T_1$ to the second thickness $T_2$ can be about 1:1, about 1:2, about 1:3, between about 1:1 and about 1:2, or between about 1:2 and about 1:3. In some examples, the thickness $T_2$ of the component 202 can be greater than about 1.5 millimeters (mm), between about 1.5 mm and about 2 mm, between about 2 mm and about 4 mm, between about 4 mm and about 6 mm, between about 6 mm and about 9 mm, between about 9 mm and about 12 mm, or greater than 12 mm.

The thickness $T_2$ of the component 202 can be equal to or less than the distance $D_2$ the component 202 extends beyond the periphery $P_2$. In some examples, the second thickness $T_2$ and the distance $D_2$ can form a ratio. For example, the ratio of the second thickness $T_2$ to the second distance $D_2$ can be about 1:1, about 1:2, about 1:3, between about 1:1 and about 1:2, or between about 1:2 and about 1:3.

Figure 2D:
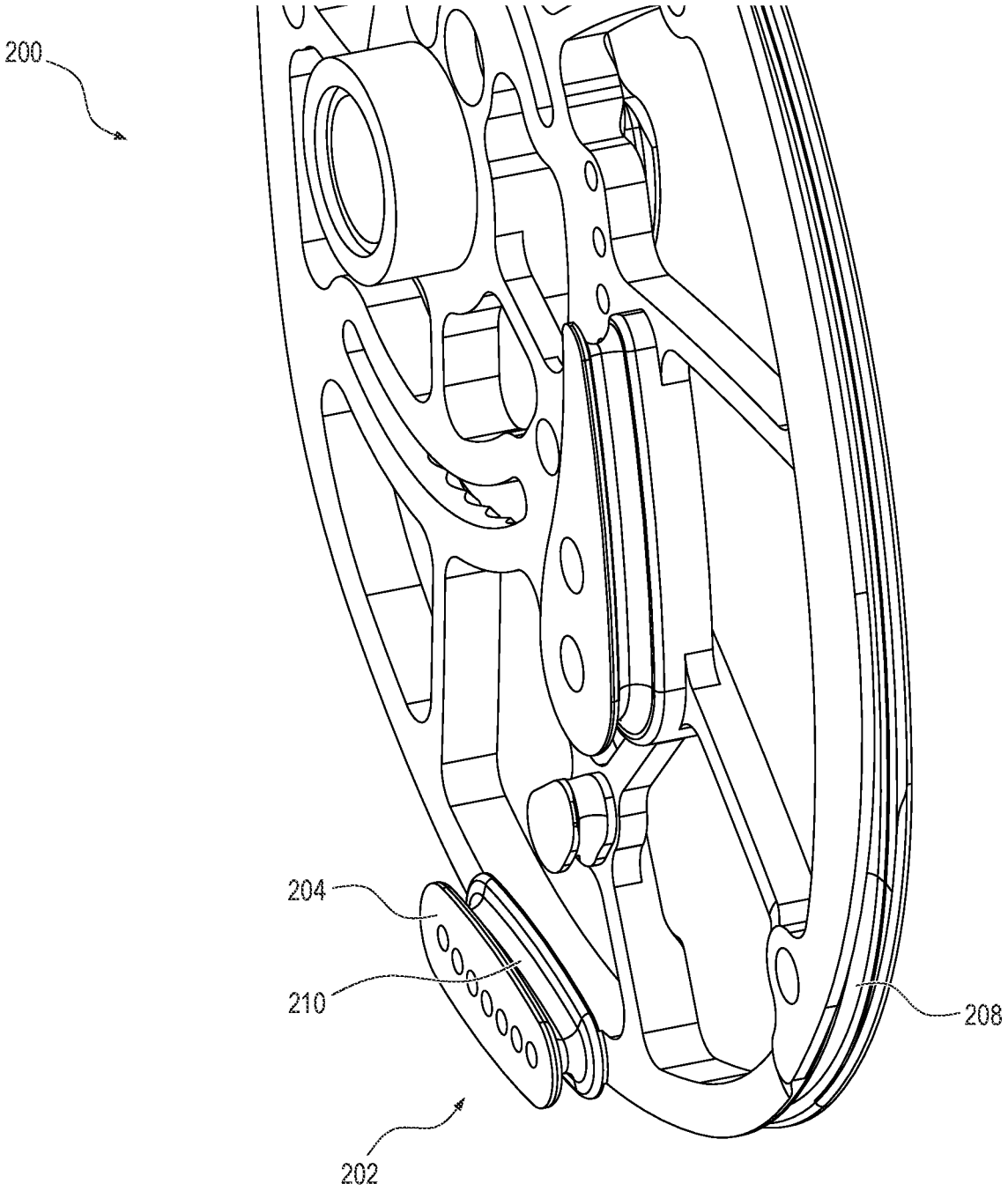
FIG. 2D is a perspective side view of the cam, according to some embodiments.

FIG. 2D shows a detail perspective view of the cam 200 with the elastomeric element 206 removed from the body 204. In some examples, the body 204 can form or define a feature 210 configured to at least partially receive the elastomeric element 206. For example, the feature 210 can be one or more channels, conduits, through-holes, blind-holes, protrusions, recesses, apertures, combinations thereof, or any other feature capable of affixing the elastomeric element 206 to the body 204. The elastomeric element 206 can be at least partially disposed within the feature 210, for example, the elastomeric element 206 can be an O-ring and the feature 210 can be a groove formed within the body 204 that partially receives the O-ring. The elastomer element 206 can be disposed between the body 204 and a support surface (e.g., support surface 126) while the archery bow is placed upright on the support surface, thereby limiting or preventing contact between the cam 200 and the support surface. While the component 202 is described herein as including the elastomeric element 206, in some examples, the component 202 may only include the body 204 such that a portion of the body 204 defines an engagement surface positioned relative to the cam assembly to contact a support surface when the archery bow is placed upright on the support surface. In some examples, the body 204 can be at least partially formed from a polymer, metal, or ceramic material. For example, the body 204 can be molded or co-molded and fastened to the cam 200 by one or more fasteners (not shown).

Figure 3A:
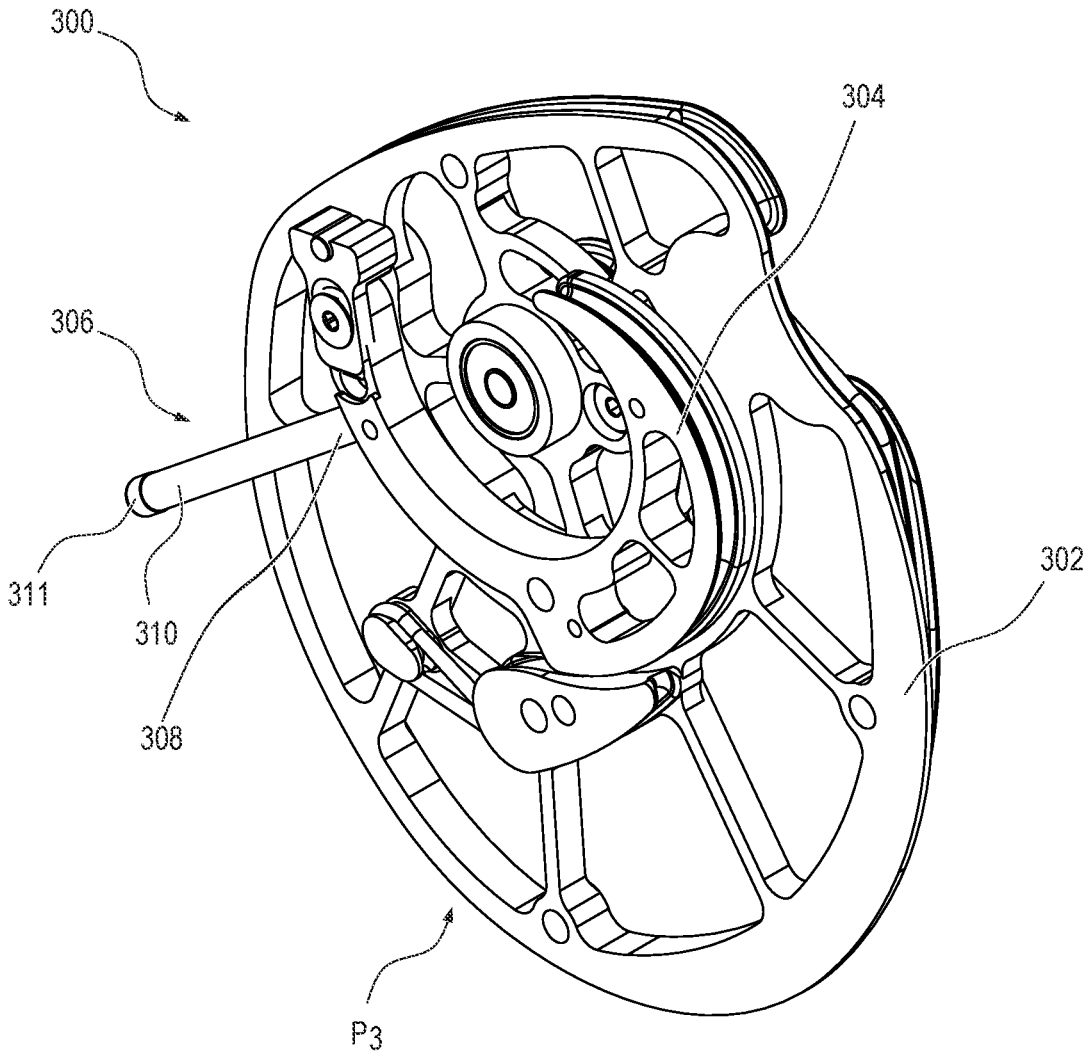
FIG. 3A is a perspective side view of a cam assembly, according to some embodiments.

FIG. 3A shows a perspective side view of a cam assembly 300 including a cam 302, a module 304, and a component 306. The module 304 can be coupled to the cam 302 by one or more fasteners (now shown). In some examples, the module 304 can be coupled to the cam 302 at one of a plurality of positions on the cam 302. The component 306 can include a polymer, a metal, a ceramic, or a combination thereof. For example, the component 306 can be manufactured from a fiber, such as, a carbon fiber or fiberglass. In some examples, the component 306 can be at least partially made from a metal alloy, such as, a 6061 aluminum alloy. In some examples, the component 306 can be molded or co-molded from a polymer, such as, a polyethylene or a polypropylene.

The component 306 can include a proximal end 308 and a distal end 310. The proximal end 308 can couple to the module 304 or the cam 302. The distal end 310 can extend beyond a periphery $P_3$ of the cam 302 and contact a support surface (not shown) when the archery bow is placed upright on the support surface. That is, a portion or segment of the periphery $P_3$ can define a plane and the proximal and distal ends 308, 310 of the component 306 can be disposed on opposite sides of the plane. While the component 306 is depicted as substantially cylindrical in FIGS. 3A and 3B, the component 306 can comprise any shape or dimension capable of extending from the module 304 and/or cam 302 beyond the periphery $P_3$ to contact the support surface.

Figure 3B:
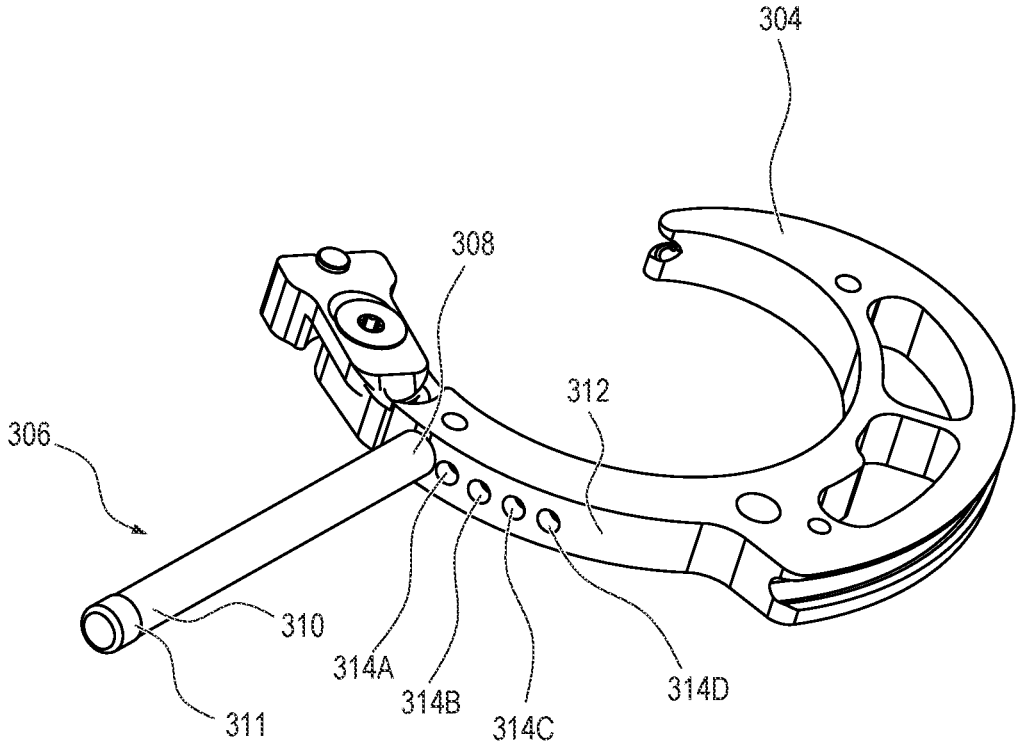
FIG. 3B is a perspective bottom view of a module and component, according to some embodiments.

In some examples, the distal end 310 can include a polymer or other elastomeric material that can engage or contact the support surface while the archery bow is placed upright on the support surface. For example, the distal end 310 can include a rubber cap or boot 311 that engages the support surface when the archery bow is placed upright on the support surface. As shown in FIG. 3B, the component 306 can be affixed to a sidewall 312 of the module 304, for example, the proximal end 308 of the component 306 can be received within one of a plurality of threaded apertures 314A-314D formed within the sidewall 312. Each threaded aperture 314A-314D can correlate to a particular orientation of the cam 302 and/or a particular orientation of the module 304 while the archery bow is in a brace position. In other words, the component 306 can be affixed to the module 304 such that the component 306 is capable of contacting the support surface even when one or more elements of the cam assembly 300 are movable between various orientations relative to the support structure.

Figure 4A:
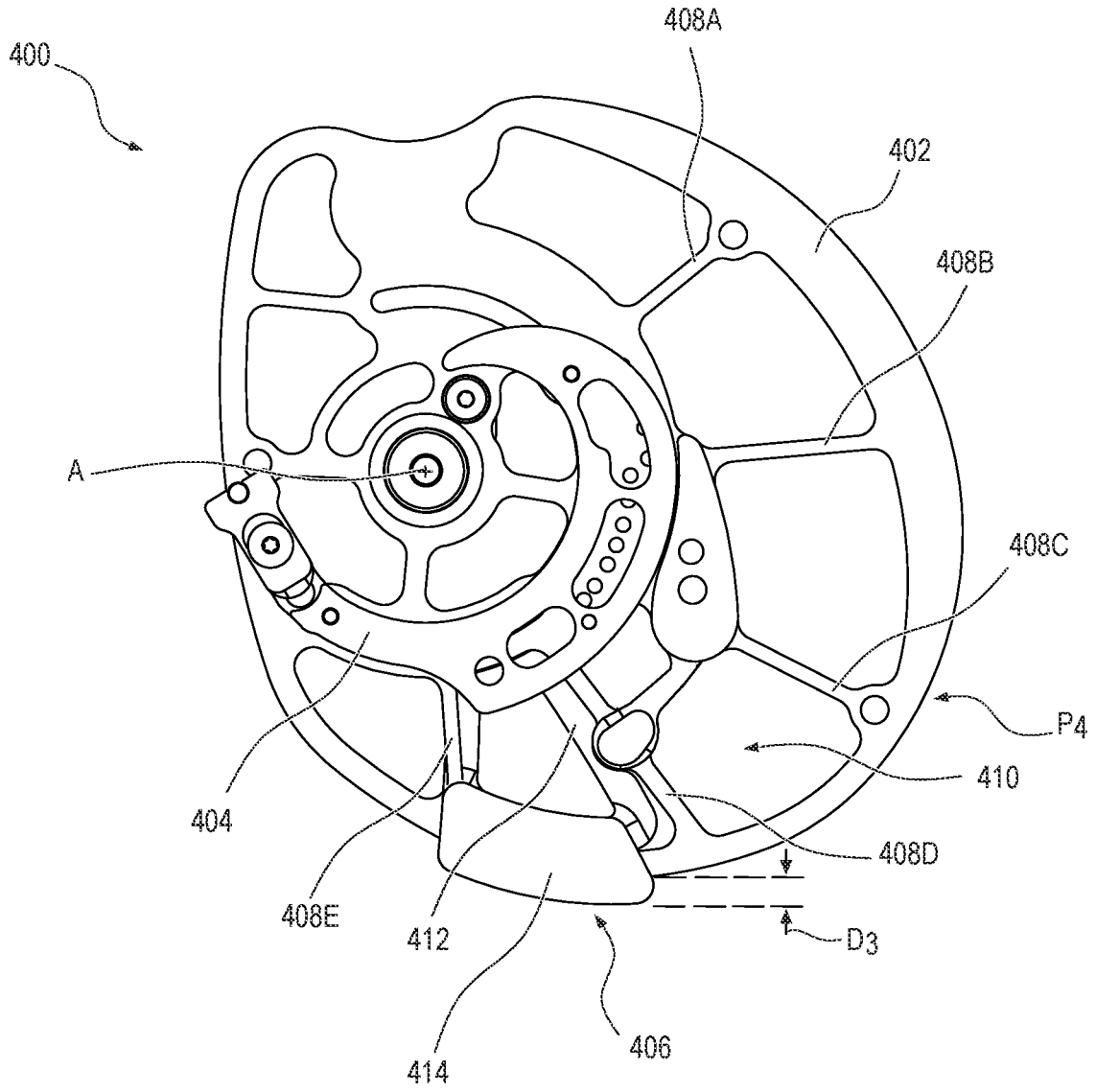
FIG. 4A is a side view of a cam assembly, according to some embodiments.
Figure 4B:
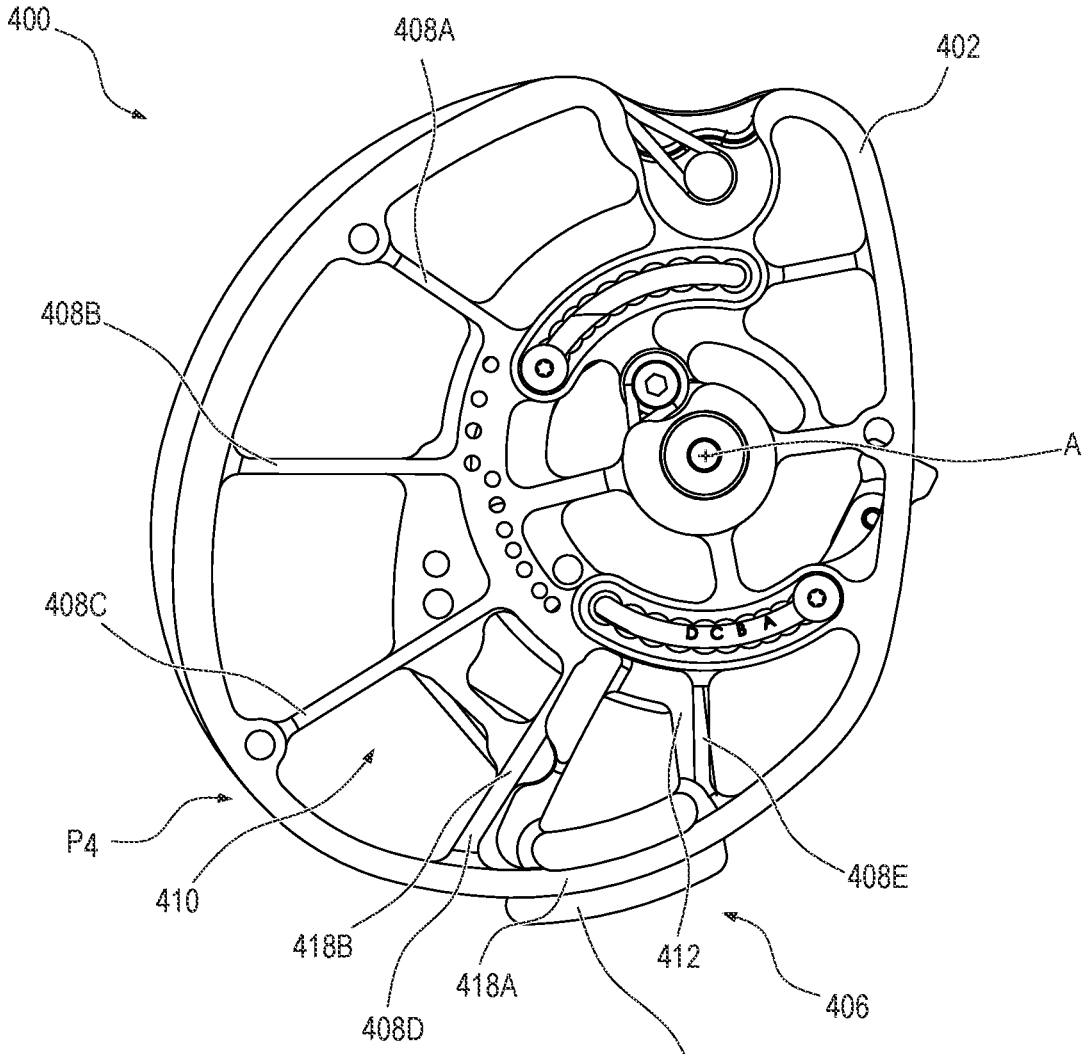
FIG. 4B is a side view of the cam assembly, according to some embodiments.
Figure 4C:
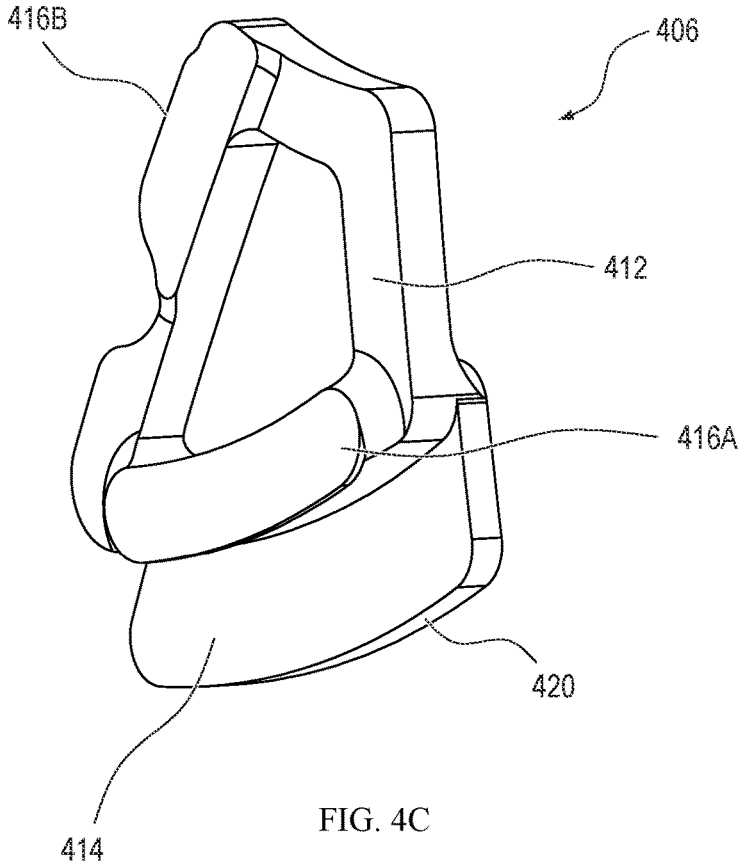
FIG. 4C is a perspective side view of a component of the cam assembly, according to some embodiments.
Figure 4D:
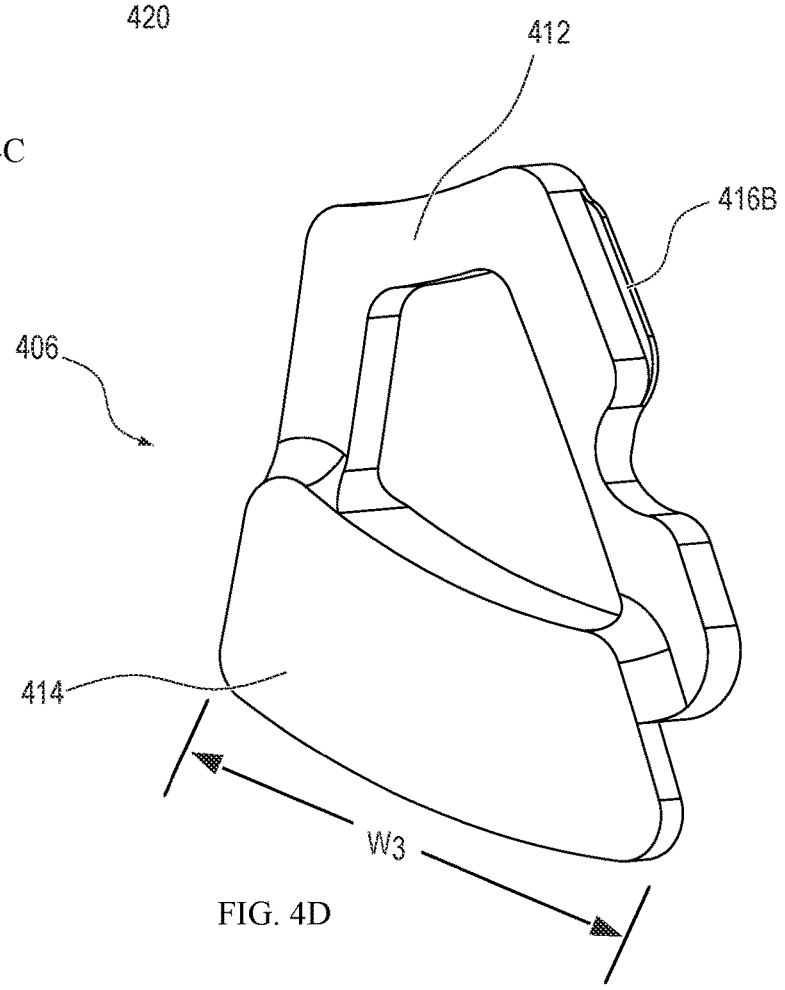
FIG. 4D is a perspective side view of the component of the cam assembly, according to some embodiments.

FIG. 4A shows a side view of a cam assembly 400 for an archery bow including a cam 402, a module 404, and a component 406. The module 404 can be coupled to the cam 402 by one or more fasteners (not shown). In some examples, the module 404 can be coupled to the cam 402 at one of a plurality of positions on the cam 402. The cam 402 can include a plurality of structural supports (e.g., structural supports 408A-408E) that extend away from a radial center (i.e., an axis of rotation A) of the cam 402 toward a periphery $P_4$ of the cam 402. In some examples, two or more of the structural supports 408A-408E can be displaced from one another forming one or more voids or cavities within the cam 402. For example, structural support 408C and structural support 408D can be displaced from one another to form a cavity 410. In some examples, the component 406 can be clipped, fastened, wedged, or otherwise positioned within one or more cavities (e.g., cavity 410) defined by the structural supports 408A-408E.

In some examples, the component 406 can include a body portion 412 and a protruding portion 414. The body portion 412 can be disposed within the cavity and adjacent two or more of the structural supports 408A-408E. The protruding portion 414 extends or protrudes beyond the periphery $P_4$ of the cam 402 to enable the component 406 to contact a support surface (e.g., support surface 126) when the archery bow is placed upright on the support surface. The component 406 can include a polymer, a metal, a ceramic, or a combination thereof. For example, the component 406 can be manufactured from a fiber, such as, a carbon fiber or fiberglass. In some examples, the component 406 can be at least partially made from a metal alloy, such as, a 6061 aluminum alloy. In some examples, the component 406 can be molded or co-molded from a polymer, such as, a polyethylene or a polypropylene. The functionality and other aspects of the component 406 will be further described below with reference to FIGS. 4C-4D.

In some examples, the component 406 can include one or more sidewalls 416A, 416B extending from the body portion 412. The one or more sidewalls 416A, 416B can engage one or more surfaces on the cam 402 to form an interference fit between the component 406 and the cam 402 to retain the component 406 to the cam 402. For example, the sidewall 416A can engage a surface 418A of the cam 402 while the protruding portion 414 engages a surface (i.e., a lateral surface of the cam 402 opposite the surface 418A) to retain the component 406 to the cam 402. Additionally, or alternatively, the sidewall 416B can engage a surface 418B of the cam 402 to retain the component 406 to the cam 402. In some examples, the component 406 can clip-in or snap-in a portion of the cam 402 without requiring fasteners or other heavy hardware increasing the weight of the cam assembly 400.

The protruding portion 414 can form or define an engagement surface 420. In some examples, the engagement surface 420 can extend substantially parallel to the periphery $P_4$ of the cam 402. For example, the protruding portion 414 can have a width $W_3$ and the engagement surface 420 can extend along at least a portion of the width $W_3$. The protruding portion 414 at least partially extends beyond the periphery $P_4$ by a distance $D_3$. In some examples, the width $W_3$ can be equal to or greater than the distance $D_3$. In some examples, the width $W_3$ and the distance $D_3$ can form a ratio (i.e., width to distance). The ratio can be about 1:1, between about 1:1 and about 1.5:1, between about 1.5:1 and about 2:1, between about 2:1 and about 2.5:1, between about 2.5:1 and about 3:1, or greater than 3:1. In some examples, the protruding portion 414 can include a plurality of discrete protrusions which each form or define respective engagement surfaces 420.

In some examples, the width $W_3$ can be at least 0.5 centimeters (cm), between about 0.5 cm and about 1 cm, between about 1 cm and about 1.5 cm, between about 1.5 cm and about 2 cm, between about 2 cm and about 2.5 cm, between about 2.5 cm and about 3 cm, or greater than 3 cm. In some examples, the distance $D_3$ can be at least 2 millimeters (mm), between about 2 mm and about 4 mm, between about 4 mm and about 6 mm, between about 6 mm and about 8 mm, between about 8 mm and about 10 mm, between about 10 mm and about 15 mm, or greater than 15 mm.

Figure 5A:
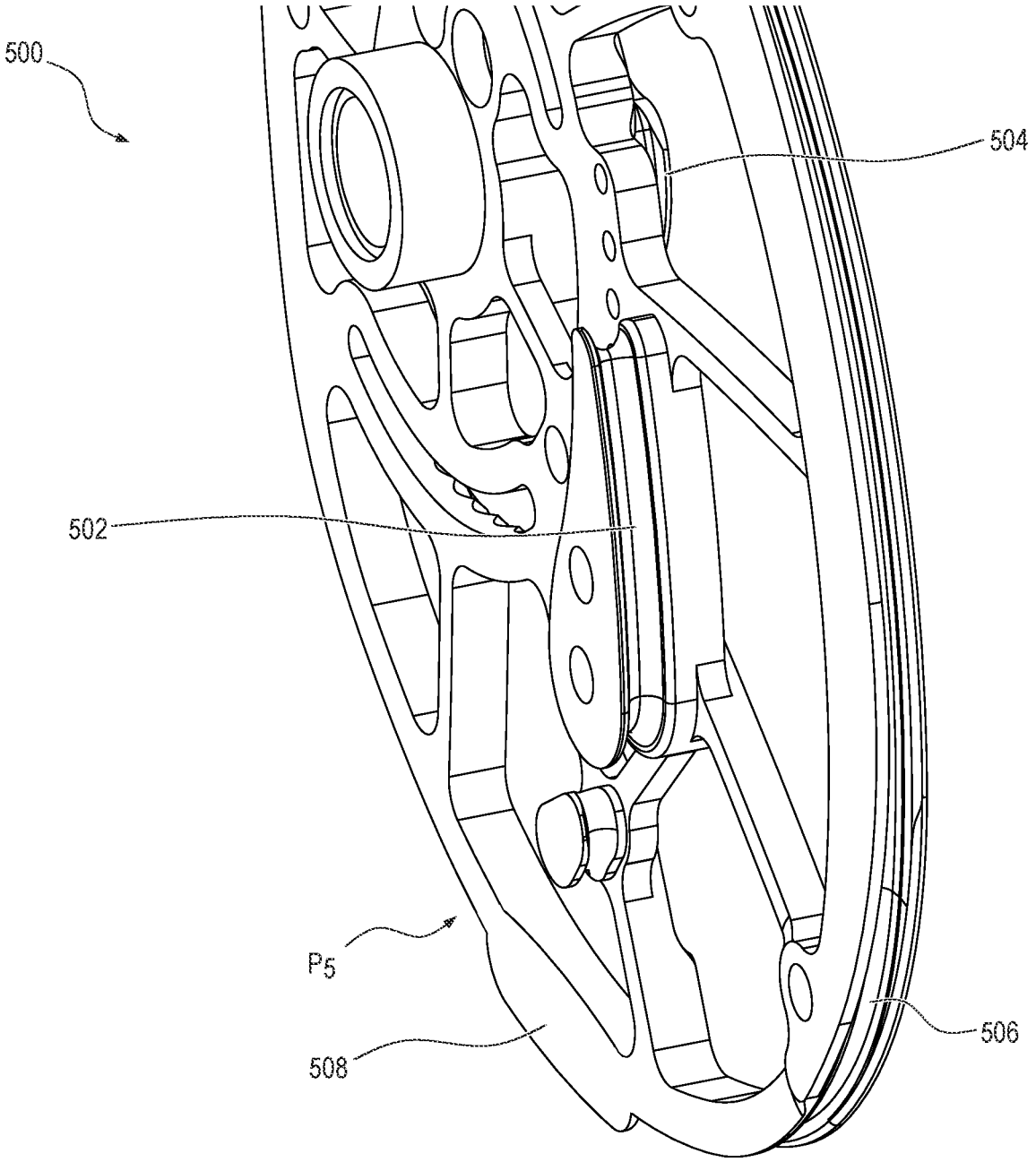
FIG. 5A is a detail side view of a cam for an archery bow, according to some embodiments.
Figure 5B:
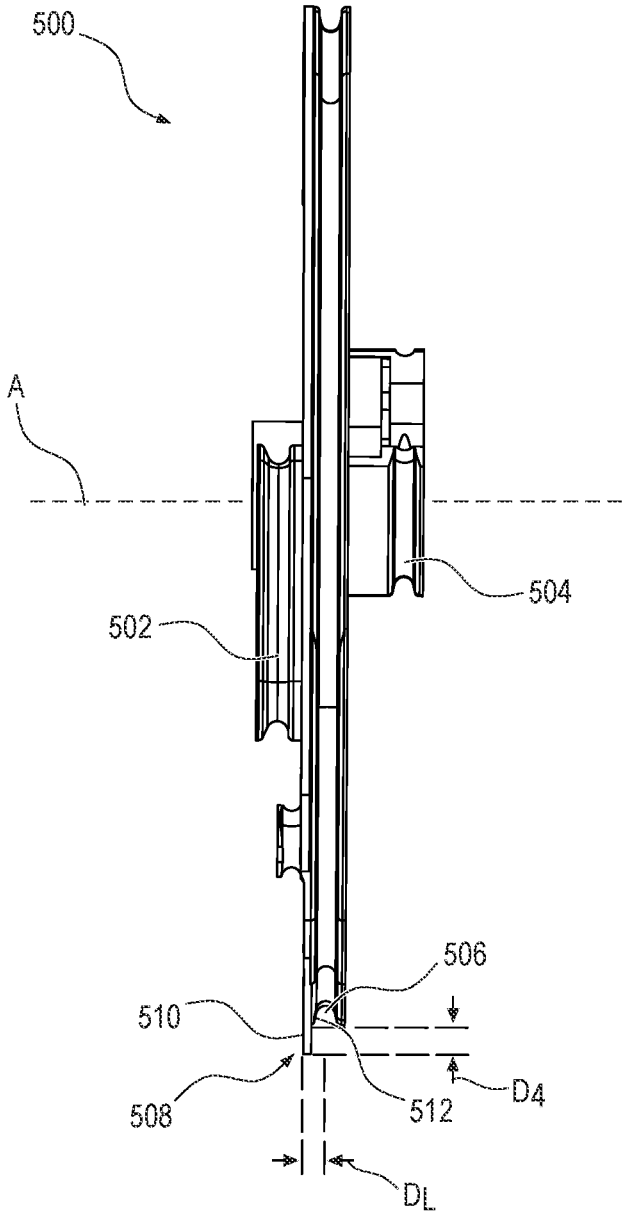
FIG. 5B is a front view of the cam, according to some embodiments.

FIGS. 5A and 5B shows a cam 500 for an archery bow. In some examples, the cam 500 can define or form one or more cable grooves 502, 504 and a bowstring groove 506. The cam 500 defines a periphery $P_5$ that is at least partially defined by a projecting portion 508. In other words, rather than extending beyond a periphery $P_5$ of the cam 500, the projection portion 508 can be integrally formed with the cam 500 to define a portion of the periphery $P_5$ of the cam 500. The projecting portion 508 can extend a distance $D_4$ from the bowstring groove 506 and away from an axis of rotation A of the cam 500. In some examples, the distance D 4 can be at least 2 millimeters (mm), between about 2 mm and about 4 mm, between about 4 mm and about 6 mm, between about 6 mm and about 8 mm, between about 8 mm and about 10 mm, between about 10 mm and about 15 mm, or greater than 15 mm.

In some examples, the projecting portion 508 can be laterally adjacent to the bowstring groove 506, such as, being displaced from the center of the bowstring groove 506 by a lateral distance $D_L$. For example, the projecting portion 508 can include a sidewall 510 that is laterally displaced from a center of the bowstring groove 506 by the lateral distance $D_L$. The lateral distance $D_L$ can be at least 3 mm, between about 3 mm and about 4 mm, between about 4 mm and about 5 mm, between about 5 mm and about 6 mm, between about 6 mm and about 7 mm, or greater than about 7 mm.

In some examples, the projecting portion 508 can be directly adjacent the bowstring groove 506. For example, the projecting portion 508 can form or at least partially define the bowstring groove 506, such as, forming or defining a portion of a sidewall 512 of the bowstring groove 506. As described with reference to other examples herein, one or more surfaces of the protruding portion 508 can contact or engage a support surface (e.g., support surface 126) when the archery bow is disposed upright on the support surface. For example, the protruding portion 508 can prevent or limit a bowstring of the archery bow and/or the bowstring groove 506 from contacting the support surface when the archery bow is disposed upright on the support surface.

In some examples, changes may be made in the function and arrangement of archery components or products discussed without departing from the spirit and scope of the disclosure, and various embodiments may omit, substitute, or add other components or accessories as appropriate. For instance, one or more portions incorporated into a particular component described with respect to certain embodiments may be combined in other embodiments.

Various aspects have been described herein with reference to certain specific embodiments and examples. However, they will be recognized by those skilled in the art that many variations are possible without departing from the scope and spirit of the inventions disclosed herein, in that those inventions set forth in the claims below are intended to cover all variations and modifications of the inventions disclosed without departing from the spirit of the inventions. The terms "including:" and "having" come as used in the specification and claims shall have the same meaning as the term "comprising."

What is claimed:

1. An archery bow, comprising:
- a riser having an upper portion and a lower portion;
- an upper limb coupled to the upper portion of the riser;
- a lower limb coupled to the lower portion of the riser;
- a bowstring extending between the upper limb and the lower limb;
- a cable;
- an upper cam assembly; and
- a lower cam assembly, comprising:
  - a rotatable member rotatably coupled to the lower limb; and
  - a component affixed to the rotatable member, the component comprising:
    - a body portion protruding beyond a periphery defined by the rotatable member; and
    - an elastomeric material coupled to the body portion, the elastomeric material forming a surface configured to contact a support surface when the archery bow is placed upright on the support surface, the body portion defining a recess configured to at least partially receive the elastomeric material.

2. The archery bow of claim 1, wherein the component is a first component and the lower cam assembly further comprises a second component configured to engage the cable when the bowstring is drawn by an archer.

3. The archery bow of claim 1, wherein the component is affixed to the rotatable member by a fastener.

4. The archery bow of claim 1, wherein:
- the component has a width equal to 3 cm or between 0.5 cm and 3 cm.

5. The archery bow of claim 1, wherein the component is integrally formed with the rotatable member.

6. The archery bow of claim 1, wherein the recess is a groove and the elastomeric material is an O-ring disposed within the groove.

7. The archery bow of claim 1, wherein:
- a surface of the lower limb defines a plane;
- the component is wholly disposed on a first side of the plane when the archery bow is in a brace state; and
- a handle portion of the riser is wholly disposed on a second side of the plane.

8. The archery bow of claim 1, wherein:
- a portion of the periphery defines a plane;
- a proximal end of the component is disposed on a first side of the plane; and
- a distal end of the component is disposed on a second side of the plane.

9. The archery bow of claim 1, wherein the component comprises a plurality of discrete protrusions.

10. An archery bow, comprising:
- a riser having a handle portion;
- a limb coupled to the riser, a surface of the limb defining a first plane;
- a bowstring; and
- a cam assembly, comprising:
  - a rotatable member rotatably coupled to the limb, the rotatable member defining a bowstring groove;
  - a first component configured to engage a cable when the bowstring is drawn by an archer; and
  - a second component affixed to the rotatable member and wholly disposed on a first side of a second plane formed within the bowstring groove, the second component forming an engagement surface configured to contact a support surface while the archery bow is disposed upright on the support surface, the second component and the handle portion wholly disposed on opposing sides of the first plane when the archery bow is in a brace state.

11. The archery bow of claim 10, wherein the cam assembly is a first cam assembly and the archery bow further comprises a second cam assembly, the second cam assembly configured to be displaced further from the support surface than the first cam assembly while the archery bow is disposed upright on the support surface.

12. The archery bow of claim 10, wherein the engagement surface is a first engagement surface of at least two distinct engagement surfaces that retain the archery bow upright on the support surface.

13. The archery bow of claim 12, wherein:

the at least two distinct engagement surfaces comprise the first engagement surface, a second engagement surface, and a third engagement surface; and the second engagement surface and the third engagement surface are disposed on opposing sides of a center plane defined by the riser.

14. The archery bow of claim 10, wherein only a portion of the engagement surface contacts the support surface while the archery bow is disposed upright on the support surface.

15. The archery bow of claim 10, wherein:

the first component is repositionable on the rotatable member about an axis of rotation of the rotatable member; and the second component is integrally formed with the rotatable member.

16. The archery bow of claim 10, wherein the second component comprises an elastomeric material, the engagement surface at least partially formed by the elastomeric material.

17. A component for an archery bow, comprising:

a body configured to be affixed to or integrally formed with a rotatable member of an archery bow, the body defining a portion protruding beyond a periphery defined by the rotatable member, the body having a thickness that is equal to or greater than a distance the portion protrudes beyond the periphery, the body defining a circumferential groove; and an elastomeric material at least partially received within the circumferential groove, the elastomeric material positioned to contact a support surface while the archery bow is disposed upright on the support surface.

18. The component of claim 17, wherein elastomeric material is an O-ring.

* * * * *